US006599119B1

(12) United States Patent
Wood et al.

(10) Patent No.: US 6,599,119 B1
(45) Date of Patent: Jul. 29, 2003

(54) APPARATUS AND METHOD TO CONTROL EMISSIONS OF NITROGEN OXIDE

(75) Inventors: Stephen C. Wood, Houston, TX (US); Ravindra K. Agrawal, Houston, TX (US)

(73) Assignee: Entropy Technology and Environmental Consultants, LP, Houston, TX (US)

( * ) Notice: Subject to any disclaimer, the term of this patent is extended or adjusted under 35 U.S.C. 154(b) by 0 days.

(21) Appl. No.: 10/071,428

(22) Filed: Feb. 7, 2002

Related U.S. Application Data

(60) Provisional application No. 60/272,361, filed on Mar. 2, 2001, and provisional application No. 60/268,051, filed on Feb. 13, 2001.

(51) Int. Cl.[7] ..... F23L 7/00

(52) U.S. Cl. ..... 431/115; 431/170

(58) Field of Search ..... 431/5, 12, 115, 431/116, 170, 9, 174, 326, 328; 422/176, 177; 60/723

(56) References Cited

U.S. PATENT DOCUMENTS 3,922,136 A * 11/1975 Koch ..... 431/115
4,995,807 A * 2/1991 Rampley et al. ..... 431/115
5,259,342 A 11/1993 Brady et al.
5,511,971 A * 4/1996 Benz et al. ..... 431/115
6,247,917 B1 6/2001 Berger et al.
6,293,275 B1 * 9/2001 Wunning ..... 431/116

FOREIGN PATENT DOCUMENTS

JP 54-39222 * 3/1979
JP 54-39223 * 3/1979

OTHER PUBLICATIONS

Agrawal & Wood, Cost–Effective NOx Reduction, *Chemical Engineering*, Feb. 2001.

* cited by examiner

*Primary Examiner*—James C. Yeung
(74) *Attorney, Agent, or Firm*—Kenneth H. Johnson

(57) ABSTRACT

A combustion apparatus which has a post combustion hot gas fan and a recirculation duct positioned down stream from the fan to reduce NOx emissions by returning a portion of the exhaust from the combustion zone back to the combustion zone. For example, in one embodiment the increased velocity of the exhaust gas stream from the post combustion hot gas fan which is required to overcome the pressure drop in a post combustion treatment unit is used as the motive force for the recirculation of a portion of the exhaust to the combustion zone to reduce the NOx exiting the apparatus to a level below that of the post combustion treatment alone.

11 Claims, 4 Drawing Sheets

APPARATUS AND METHOD TO CONTROL EMISSIONS OF NITROGEN OXIDE

This application claims benefit of Ser. No. 60/268051 filed Feb. 13, 2001 and claims benefit of Ser. No. 60/272361 filed Mar. 2, 2001.

BACKGROUND OF THE INVENTION

1. Field of the Invention

The present invention relates to an apparatus and method for improving flue gas recirculation to minimize the oxides of nitrogen in exhaust emissions.

2. Related Information

Nitrogen oxides ("NOx") are among the primary air pollutants emitted from combustion processes. NOx emissions have been identified to contribute to ground-level ozone formation, visibility degradation, acid rain and human health concerns. As a result environmental regulations have been the main driver forcing industry to install systems to control NOx emissions.

There are two primary sources for NOx generated during combustion: Fuel NOx and Thermal NOx. NOx formed due to conversion of chemically bound nitrogen is referred to as Fuel NOx. Thermal NOx refers to NOx formed from high temperature oxidation (or "fixation") of atmospheric nitrogen. NO is the major constituent of thermal NOx and its formation can be modeled by the Zeldovich equation:

$$[NO]=k_1\cdot\exp(-k_2/T)\cdot[N_2]\cdot[O_2]^{1/2}\cdot t$$

where, [ ]=mole fraction, k's=constants, T=temperature, and t=residence time. *The Oxidation of Nitrogen in Combustion and Explosion*, J. Zeldovich, Acta Physiochim, U.S.S.R. (Moscow), 21 (4), pp 577–628 (1946). The equation indicates that NOx formation is an exponential function of temperature and a square root function of oxygen concentration. Thus, by manipulating the temperature or oxygen concentration the formation of thermal NOx can be controlled. The main control strategies for reducing thermal NOx emissions can be characterized into two types: (i) Stoichiometry-based combustion modification systems designed to control the mixing of fuel and air to modify the concentration of oxygen in the flame zone, and (ii) Dilution-based combustion modification systems designed to reduce flame temperature in the flame zone. Post Combustion control of flue gas to remove NOx such as Selective Catalytic Reduction (SCR) and Non-Selective Catalytic Reduction (NSCR) are not only expensive but also operate on a different principle from the present invention.

Stoichiometry-based Combustion Control techniques involve altering the oxygen concentration in the flame zone to lower NOx formation. Examples for stoichiometry-based combustion controls include: Low NOx Burners and Off-Stoichiometric Combustion (e.g., Over Fire Air, and Burners Out of Service). These technologies effectively control NOx emissions by providing air staging to create an initial, fuel-rich zone (partial combustion zone) followed by an air-rich zone to complete the combustion process. Some burner manufacturers also offer fuel staging, which results in ultra low levels of NOx, primarily because they are also designed to recirculate flue gas.

Dilution-based Combustion Control techniques such as Flue Gas Recirculation and Water/Steam Injection control technologies reduce thermal NOx formation by introducing inerts, which absorb heat, thereby, reducing peak flame temperatures. Although dilution methods also reduce oxygen concentration in the flame zone, little reduction in NOx is expected from this mechanism. Water Injection reduces flame temperatures by absorbing the latent heat of vaporization, as such; it results in decreasing the efficiency. Thus, it is mainly recommended as a temporary control measure to reduce NOx during peaking periods.

Flue Gas Recirculation ("FGR") technology, also referred to as Windbox-FGR, does not suffer from this handicap and has minimal impact on efficiency. In a typical Windbox-FGR application, about 10 to 25% of the flue gases are recycled back to the combustion zone resulting in NOx reduction of up to 80%. Recirculating flue gas back to the combustion zone has been one of the most effective methods of reducing NOx emissions from gas and oil fired boilers since the early 1970's. In conventional applications, the recirculated flue gas is typically extracted from the combustion units outlet duct, upstream of the air heater. The flue gas is then returned through a separate duct and hot gas fan to the combustion air duct that feeds the windbox. The recirculated flue gas is mixed with the combustion air via air foils or other mixing devices in the duct. Windbox-FGR systems require installation of a separate hot gas FGR fan to move flue gas from the boiler exit to the air supply ducting at the windbox inlet, where mixing of the air and flue gas must be uniformly achieved by installation of appropriate mixing devices.

As more stringent rules are applied to reduce NOx emissions by 90%, many existing combustion units, including fired heaters, boilers, ethylene furnaces, incinerators, steam generators, process heaters, and the like, will need to have expensive selective catalytic reduction (SCR—treatment of exhaust gas with ammonia or other reduction or oxidation agents) systems or equivalent post combustion flue gas treatment technologies installed in order to meet the high NOx control levels. The post combustion flue gas technologies such as the SCR system, have an associated pressure drop, so to overcome the pressure drop, a hot gas fan is needed to boost the pressure of the exiting flue gas from levels typically below 1 inch of water to above 3 inches of water. In a typical application, the hot gas fan used by the post combustion flue gas treatment system boosts the pressure of the flue gas so that it can be passed over a catalyst bed to reduce NOx, before exiting through the stack.

The present invention takes advantage of the hot gas fan, used by the flue gas treatment system to reduce NOx, to redirect a portion (slip stream) of the flue gas back into the flame zone. The present invention takes advantage of any type of post combustion fan to redirect a portion of the flue gas back into the flame zone to achieve NOx reduction.

SUMMARY OF THE INVENTION

Briefly the present invention comprises an apparatus and process for flue gas recirculation wherein the apparatus comprises: a combustion unit, an exhaust duct for removing flue gas from the combustion unit, a post combustion hot gas fan for exhausting flue gas, and a recirculation line penetrating into the exhaust duct having an extractor for capturing and directing a portion of said exhausting flue gas into said combustion unit for combustion therein. The recirculation line is positioned down stream of said hot gas fan. Preferably the extractor has an opening on a surface facing the hot gas fan to allow the hot gas fan to provide the motive force to the recirculation of the flue gas, i.e., exhaust gas. The hot gas fan may be a forced draft type or an induced draft type. The combustion unit comprises a combustion zone which will preferably comprise a flame burner.

In a preferred embodiment the invention comprises an apparatus and process for flue gas recirculation wherein the apparatus comprises: a combustion unit, an exhaust duct for removing flue gas from the combustion unit, a post combustion treatment unit and a hot gas fan for moving flue gas through said post combustion treatment unit, and a recirculation line penetrating into the exhaust duct between said combustion unit and said post combustion treatment unit, said recirculation line having an extractor for capturing and directing a portion of said flue gas into said combustion treatment unit for combustion therein.

The recirculation line preferably delivers the recirculated flue gas through a diffuser into the intake air going to the burner in the combustion unit, so that a uniform combustion mixture may be obtained.

The term "combustion unit" includes fired heaters, boilers, ethylene furnaces, incinerators, steam generators, process heaters and the like. The term "duct" as used herein includes ducts, lines, flues, stacks and any equivalent elements.

DETAILED DESCRIPTIONS

Figure 1:
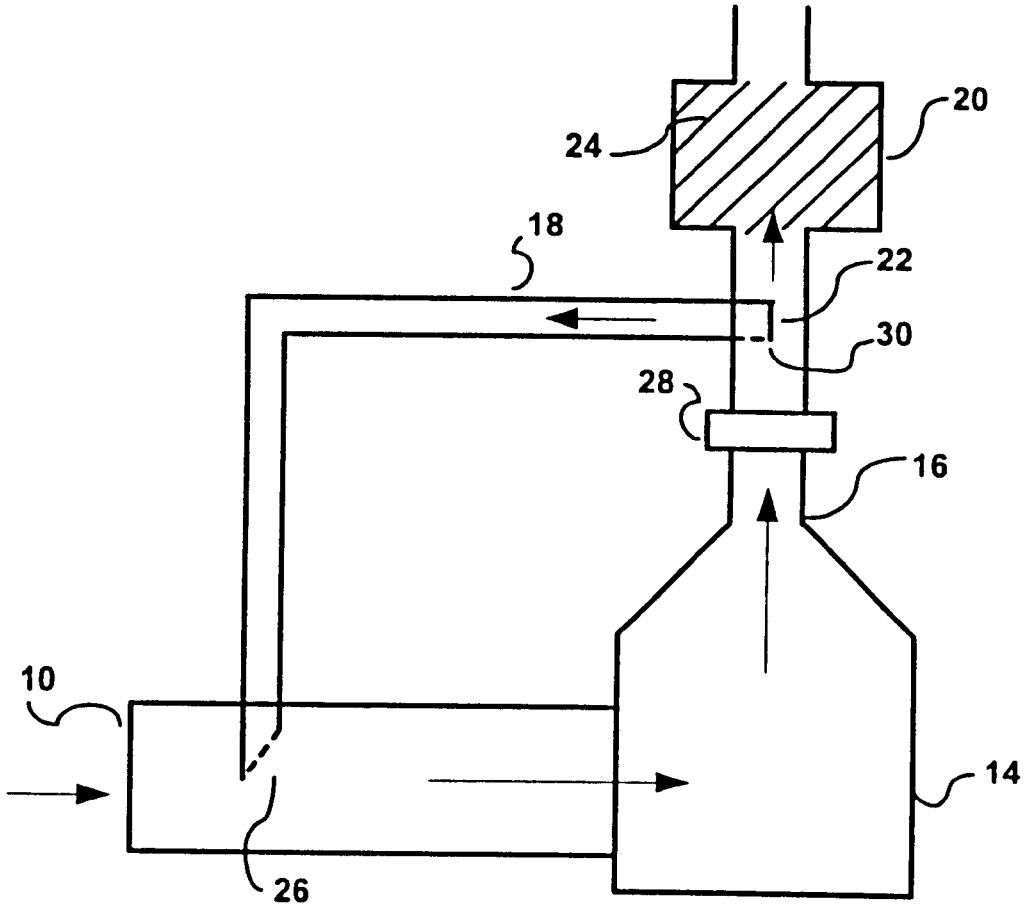
FIG. 1 is a schematic elevational representation of one embodiment of the apparatus of the present invention which has forced draft post combustion hot gas fan.

The present invention is based on the use of a post combustion hot gas fan to redirect some of the exhaust flows back into the combustion zone. By redirecting the flue gas to the flame zone, the combustion process is modified and results in reducing NOx. The hot gas fan may be used to operate the combustion unit under draft or to create a pressure head to overcome a pressure drop, for example from an air preheater or a post combustion flue gas treatment system, or merely to exhaust the flue gas through the stack. The present invention uses the pressure head developed by the hot gas fan to redirect a portion of the exhaust back to the combustion zone.

In a typical application, the recirculated exhaust gas will provide a reduction NOx over the straight exhaust, and the combined reduction due to present invention and a post combustion flue gas treatment will result in greater reduction in NOx than either post combustion treatment alone or recirculation alone.

An extractor is located in the duct carrying the exhaust stream to the post combustion treatment unit, e.g., the catalyst bed, down stream from a hot gas fan, which provides the necessary increase in the gas velocity to overcome the pressure drop in the post combustion treatment unit (PCTU). The extractor has an opening in a surface facing upstream toward the hot gas fan. The hot gas fan is sized to provide the velocity increase necessary to force the exhaust gas through the PCTU and to provide a stream of the combustion gas through the extractor and a duct back to the combustion zone, where the recycled exhaust is used in the air supply for the combustion.

In the drawings, the same components in different views or embodiments use the same numbers. The drawings are not intended to limit the invention, but are merely illustrations. Although the drawings all depict the preferred embodiment which contains a post combustion treatment unit, it should be appreciated that only the post combustion hot gas fan is required for the invention and not the post combustion treatment unit.

The arrows indicate the direction of gas flow within the system. Referring to FIG. 1 air enters through inlet line 10 to supply air for combustion of a fuel in a burner (not shown). The recirculation line 18 extends into the exhaust stack 16 and connects to the extractor 22 and enters combustion unit 14 through diffuser 26 to mix the recirculated exhaust with air feed to the burner (not shown). As the exhaust passes through exhaust stack 16, hot gas fan 28 increases the velocity of the exhaust to overcome the pressure drop in the catalyst bed 24 located in PCTU 20. The hot gas fan is sized to achieve that objective and at the same time force a portion, for example 5 to 40% of the exhaust gas, through opening 30 and line 18 to the combustion unit. The opening 30 is positioned between the combustion unit and the PCTU 20 and faces the hot gas fan.

Figure 2:
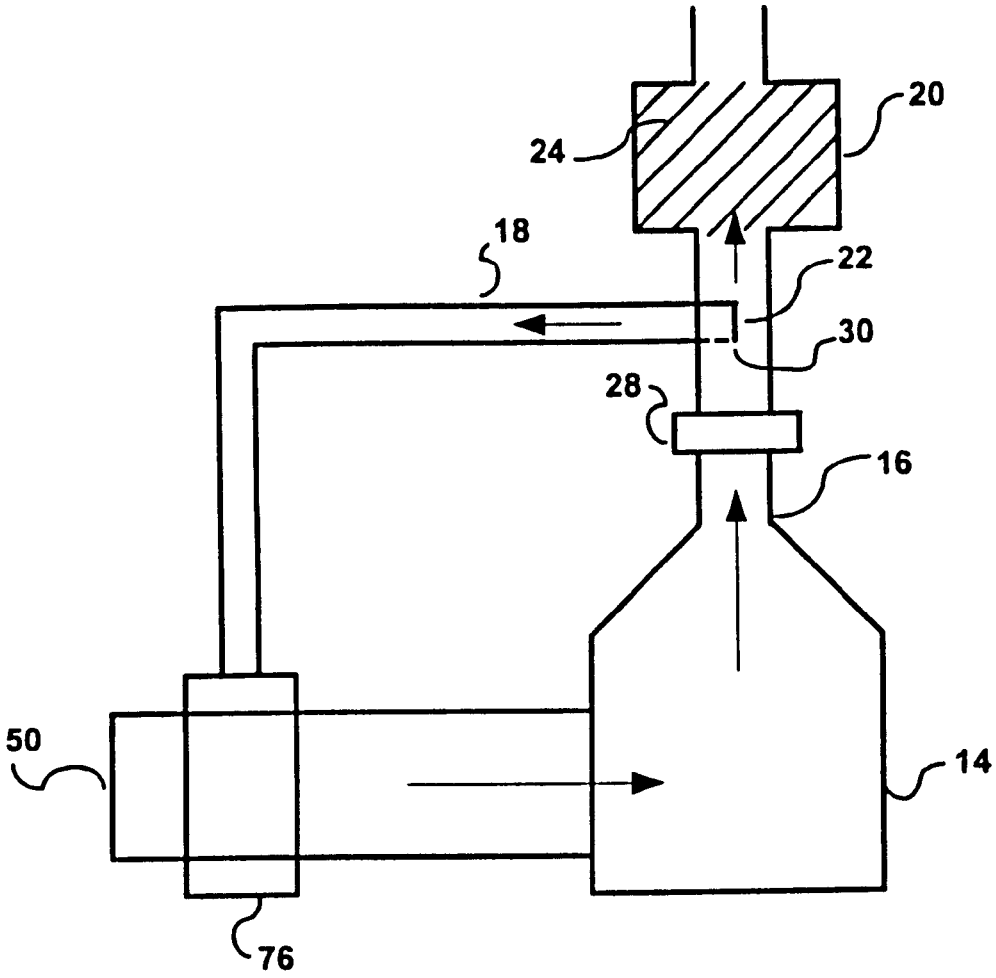
FIG. 2 is a schematic representation of an alternative embodiment of the present invention with a forced draft post combustion fan and a forced draft air intake fan.

FIG. 2 is a configuration similar to that of FIG. 1 except that the recirculation line 18 is connected to a shroud or transition duct 76 which is placed over a portion of the air intake of fan 50.

Figure 3:
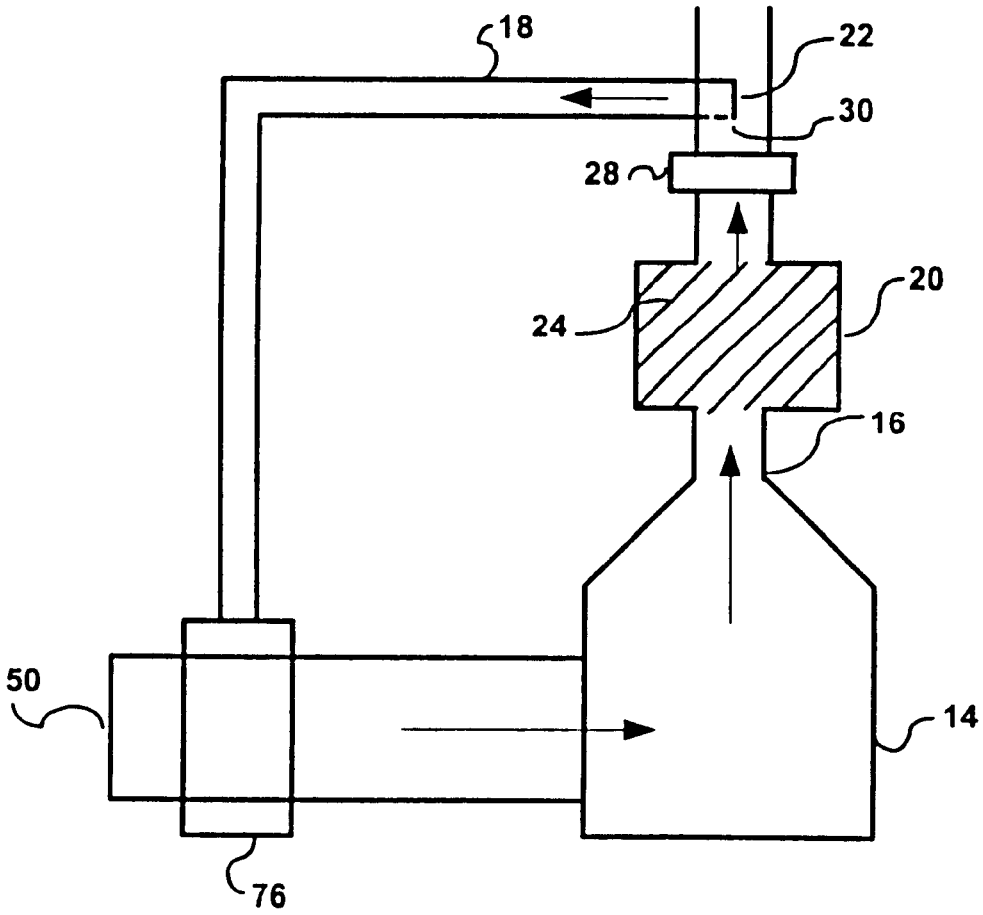
FIG. 3 is schematic representation of an alternative embodiment which has an induced draft post combustion hot gas fan and a forced draft air intake fan.

In FIG. 3 an induced draft post combustion hot gas fan 28 is located down stream from the post combustion treatment unit 20 and the recirculation line 18 is positioned downstream of the fan 28.

Figure 4:
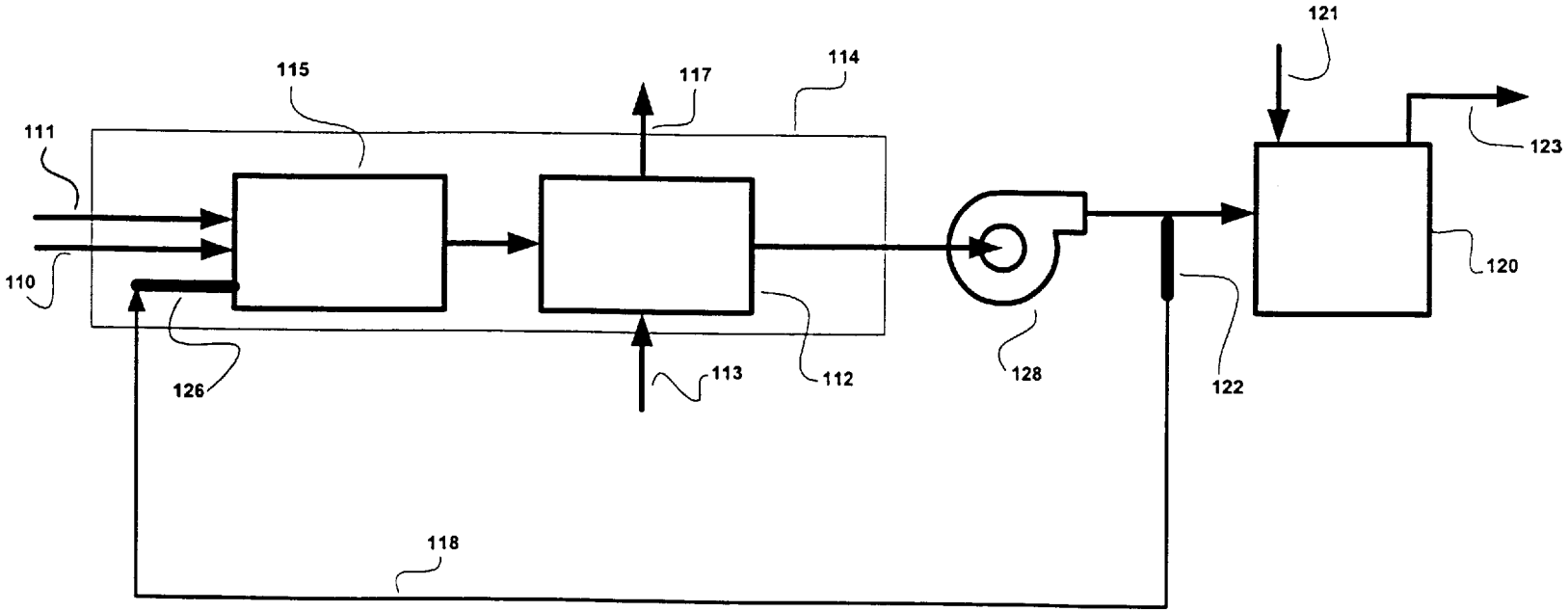
FIG. 4 is a schematic of alternative embodiment of the present invention.

In FIG. 4 the combustion system generally defined as 114 comprises the combustor 115, the heat exchanger 112 and hot gas fan 128. Air 110 and fuel 111 are fed to a combustor 115 where the mixture is burned. The flue gas produced is contacted with the heat exchanger 112 for indirect contact with a cold process stream 113 to produce the hot process stream 117. The flue gas containing NOx is passed through hot gas fan 128, where the gas velocity is increased to force the flue gas through the SCR system 120 where it is treated with ammonia 121 and a catalyst. A flue gas extractor 122 is located between the hot gas fan 128 and the SCR system 120. The extractor captures a portion of the flue gas in the combustion system and recycles it as a slip stream 118 to the combustor 115 to mix with the air and fuel. A flue gas having substantially less NOx than that of a corresponding system without the recycle slip stream exits the SCR system at point 123.

A The preferred fuels are gaseous and light liquid hydrocarbons. The drawings are not intended to limit the invention, but are merely illustrations to aid in its understanding and that the conventional appurtenant equipment commonly found on combustion units may be present.

EXAMPLE

A combustion unit, presently emitting 120 parts per million (ppm) of NOx, using a typical SCR installation (which results in NOx reduction of 90%) will result in lowering the NOx emissions to 12 ppm [120×(1–0.9)].

The contemplated typical reduction from the present invention is expected to be in the range of 50 to 80% for a corresponding NOx reduction of 60 to 24 ppm before post combustion treatment. The recycled flue gas combined with the post combustion treatment produces gas exiting the apparatus that will be well within the acceptable emissions (6–3 ppm) with minimal costs, because the present improvement is obtained by sizing the hot gas fan, which is required for the post combustion treatment, to be able to also direct a portion of the flue gas back to the flame zone. Thus, a higher capacity fan and ducting from the hot gas fan to the flame zone are only incremental increases in costs. Alternatively, if the final NOx level from the SCR is to be maintained at , e.g. 12 ppm, then with the present invention, the effective reduction required from SCR is only 50 to 80% to obtain 12 ppm NOx, compared to 90% without the invention. Thus the present invention allows the reduction of the size of the SCR, resulting in savings in material and space costs.

Another feature of the invention is that it operates on a different principle for NOx reduction when compared to Low NOx Burners, and other Off Stoichiometric combustion processes such as Over Fire Air and Burners out of Service. As such, it can be simultaneously used with them to obtain even higher reductions of NOx.

What is claimed is:

1. An apparatus for flue gas recirculation to reduce NOx emissions comprising: a combustion unit, an air feed line, a fan to provide airflow through said air feed line, an exhaust duct for removing flue gas from the combustion unit, a post combustion hot gas fan for exhausting flue gas, positioned downstream of said combustion unit, a recirculation line penetrating into the exhaust duct, extending into said air feed line and having an extractor for capturing and directing a portion of said exhausting flue gas into said combustion unit through said air feed line for combustion therein and a separate post combustion treatment unit in gaseous communication with said exhaust duct.

2. The apparatus according to claim 1 wherein said extractor is connected to a forced draft air fan connected to said combustion unit.

3. The apparatus according to claim 1 wherein said post combustion treatment unit is positioned down stream of said hot gas fan and said extractor is positioned in said exhaust duct between said hot gas fan and said post combustion treatment unit.

4. The apparatus according to claim 1 wherein said hot gas fan is positioned down stream of said post combustion treatment unit and said extractor is positioned down stream of said hot gas fan.

5. An apparatus according to claim 1 wherein said recirculation line is positioned down stream of said hot gas fan.

6. An apparatus comprising: a combustion unit, an exhaust duct for removing flue gas from the combustion unit, a separate post combustion treatment unit in gaseous communication with said combustion unit, a hot gas fan positioned between said combustion unit and said post combustion treatment unit for delivering flue gas through said post combustion unit, and a recirculation line penetrating into the exhaust duct between said hot gas fan and said post combustion unit said recirculation line having an extractor for capturing and directing a portion of said flue gas into said combustion unit for combustion therein.

7. The apparatus according to claim 6 wherein the extractor has an opening on a surface facing the hot gas fan.

8. The apparatus according to claim 6 wherein the recirculation line is connected to a diffuser in said combustion unit.

9. The apparatus according to claim 7 wherein the recirculation line is connected to a diffuser in said combustion unit.

10. The apparatus according to claim 6 wherein said combustion unit comprises a combustor for burning a mixture of said air fuel and flue gas.

11. The apparatus according to claim 6 wherein said combustion unit comprises a heat exchanger for indirect contact of said flue gas and process stream.

* * * * *